United States Patent [19]

Kennedy

[11] Patent Number: 4,848,854

[45] Date of Patent: Jul. 18, 1989

[54] CONTINUOUS TOWEL CABINETS

[75] Inventor: James W. Kennedy, Buxted, England

[73] Assignee: David Kennedy (Engineers) Holdings Limited, East Grinstead, England

[21] Appl. No.: 180,116

[22] Filed: Apr. 11, 1988

[30] Foreign Application Priority Data

Apr. 22, 1987 [GB] United Kingdom ..... 8709510

[51] Int. Cl.[4] ..... B65H 19/00

[52] U.S. Cl. ..... 312/38

[58] Field of Search ..... 312/38, 37, 39

[56] References Cited

U.S. PATENT DOCUMENTS

| | | | |
|---|---|---|---|
| 1,809,873 | 6/1931 | Steiner et al. | 312/38 |
| 2,103,403 | 12/1937 | Birr | 312/38 |
| 3,637,275 | 1/1972 | Bahnsen | 312/38 |
| 3,728,001 | 4/1973 | Bahnsen . | |
| 3,893,738 | 7/1975 | Bahnsen | 312/38 |
| 4,243,278 | 1/1981 | Gray | 312/38 |

FOREIGN PATENT DOCUMENTS

| | | |
|---|---|---|
| 0116228 | 1/1983 | European Pat. Off. . |
| 0173978 | 8/1985 | European Pat. Off. . |
| 528256 | 11/1972 | Switzerland . |
| 1033306 | 6/1966 | United Kingdom . |
| 1138447 | 7/1966 | United Kingdom . |
| 1137003 | 12/1968 | United Kingdom . |
| 1143948 | 2/1969 | United Kingdom . |
| 1192546 | 5/1970 | United Kingdom . |
| 1198198 | 7/1970 | United Kingdom . |
| 1288780 | 9/1972 | United Kingdom . |
| 1460177 | 12/1976 | United Kingdom . |
| 2120205 | 5/1982 | United Kingdom . |
| 1371314 | 9/1982 | United Kingdom . |
| 2144101 | 6/1984 | United Kingdom . |

*Primary Examiner*—Joseph Falk

*Attorney, Agent, or Firm*—Beveridge, DeGrandi & Weilacher

[57] ABSTRACT

A continuous towel cabinet comprises a holder for a roll of clean towel, an arrangement of rollers for repeatedly allowing a length of clean towel to be dispensed into a loop beneath the holder and including a rewind roller on which an equivalent length of soiled towel is simultaneously rewound, separate take-up means for retracting the loop at the end of each cycle of operation, and a compartment for receiving the length of towel withdrawn by the loop take-up means, the soiled towel within the compartment being subsequently wound onto the rewind roller during the next or succeeding cycles of operation. The loop take-up means comprises a drive roller driven by an electric motor, and the cabinet contains an independent power source for operating the electric motor. Furthermore, there are provided control means for the motor actuated by sensing means responsive to the tension in the towel whereby after the towel is released by the user the loop will be retracted. The sensing means actuate the control means to operate the electric motor after a predetermined time delay and to stop the electric motor when the loop has been retracted.

12 Claims, 4 Drawing Sheets

CONTINUOUS TOWEL CABINETS

BACKGROUND OF THE INVENTION

1. Field of the Invention

This invention relates to continuous towel cabinets.

2. Prior Art

It is known to provide a continuous towel cabinet having a roller arrangement which allows successive lengths of clean towel to be dispensed into a loop beneath the cabinet and simultaneous rewinding of the equivalent length of soiled towel. The length of towel loop thus remains constant.

In one form of this type of cabinet which is described in British Patent Specification No. 2120205 there is provided both a rewind roller which is mechanically linked to the dispensing roller so that an equivalent length of soiled towel is taken up onto the rewind roller. There are also separate take-up means for withdrawing the trailing end of the towel into the cabinet when the end of the roll is reached. These separate take-up means include a drive roller driven by an electric motor operated from a low voltage energy source, e.g. a battery. During the normal operation of the cabinet, the electric motor is not operated and a loop of towel is maintained permanently beneath the cabinet.

It is also known to provide another type of continuous towel cabinet in which the user extends a loop of towel which is subsequently withdrawn into the cabinet at the end of each cycle of operation either mechanically, e.g. by a spring motor, or more usually by an electric motor. In such cabinets the soiled towel which is taken up, to retract the loop, is usually rewound directly onto the rewind roller. Towel cabinets of this type are employed to minimise the risk of cross-contamination between users. However, it will be appreciated, that in this type of continuous towel cabinet, when an electric motor is used, the motor has to be of sufficient power to turn the whole roll of soiled towel during each cycle of operation. It is thus necessary to provide an electric motor fed by a mains supply which is disadvantageous because an existing mains supply may not be readily at hand near the position in which the towel cabinet is required. Another disadvantage is that if there is an electrical supply failure, clean towel can be dispensed but the towel cabinet cannot operate to withdraw soiled towel. Equivalent mechanical arrangements are complicated, expensive and likely to be unreliable in use.

It has been proposed to provide separate take-up rollers for withdrawing the loop, the length of towel being retracted passing into a storage compartment from which it is rewound onto the rewind roller during the next cycle of operation. However, the means by which it has been intended to drive the rollers have been complicated and unreliable mechanical arrangements.

SUMMARY

According to the invention there is provided a continuous towel cabinet comprising a holder for a roll of clean towel, an arrangement of rollers for repeatedly allowing a length of clean towel to be dispensed into a loop beneath the holder and including a rewind roller on which an equivalent length of soiled towel is simultaneously rewound, separate take-up means for retracting the loop at the end of each cycle of operation, and a compartment for receiving the length of towel withdrawn by the loop take-up means, the soiled towel within the compartment being subsequently wound onto the rewind roller during the next or succeeding cycles of operation, the loop take-up means comprising a drive roller driven by a motor, and control means for the motor actuated by sensing means responsive to the tension in the towel whereby after the towel is released by the user the loop will be retracted, wherein the motor of the loop take-up means is an electric motor, the cabinet contains an independent power source for operating the electric motor, and the sensing means actuate the control means to operate the electric motor after a predetermined time delay and to stop the electric motor when the loop has been retracted.

In the preferred embodiment, the control means are preferably reset in the event of the sensing means sensing tension in the towel after the towel has been released by the user and before the loop has been retracted.

The power source for the electric motor is preferably at least one alkaline battery.

Preferably the separate take-up means comprises the drive roller and a pressure roller which, in use, holds the towel against the drive roller, one of said rollers being mounted for pivotal movement away from the other roller during the cycle of reloading the cabinet with a fresh roll of clean towel to allow the leading end of the new roll to be passed therebetween. In one embodiment, the clean towel is movable into an open position for reception of a fresh roll, and the pivoted roller is mounted on a carriage engageable by the clean towel holder whereby the clean towel holder moves the pivoted roller to its inoperative position when the holder is moved into its open position.

Means are preferably provided for deflaking the soiled towel as it passes from the compartment onto the rewind roller. The deflaking means preferably comprises a hanging plate over the surface of which the towel passes, the plate being capable of a swinging motion about its top edge thereby acting to prevent the towel from bunching.

Preferably the or each roller of the separate take-up means has a unidirectional clutch bearing in one end which prevents the roller from back rolling.

Between the compartment and the rewind roller the towel may be passed between further means which at least restrict back movement of the towel thereby preventing soiled towel from being pulled off the roll of soiled towel.

The sensing means may be a micro-switch operated by a bar extending transversely of the towel, the bar being mounted for movement towards the micro-switch by the towel when the towel is tightened and away from the micro-switch when the towel is loose.

Means are preferably provided for spacing a section of the front of the loop, when retracted, away from the clean towel holder to allow the user to insert his fingers between the towel and the holder in order to grip the edges of the towel before dispensing further clean towel into a loop beneath the holder.

Preferably said towel spacing means is a blister-like projection on the front of the clean towel holder, the projection being disposed centrally of the path of the towel and having a lateral dimension which is less than the width of the towel. The blister-like projection allows the user comfortably to insert his fingers behind the edges of the towel.

DESCRIPTION OF THE PREFERRED EMBODIMENT

Figure 1:
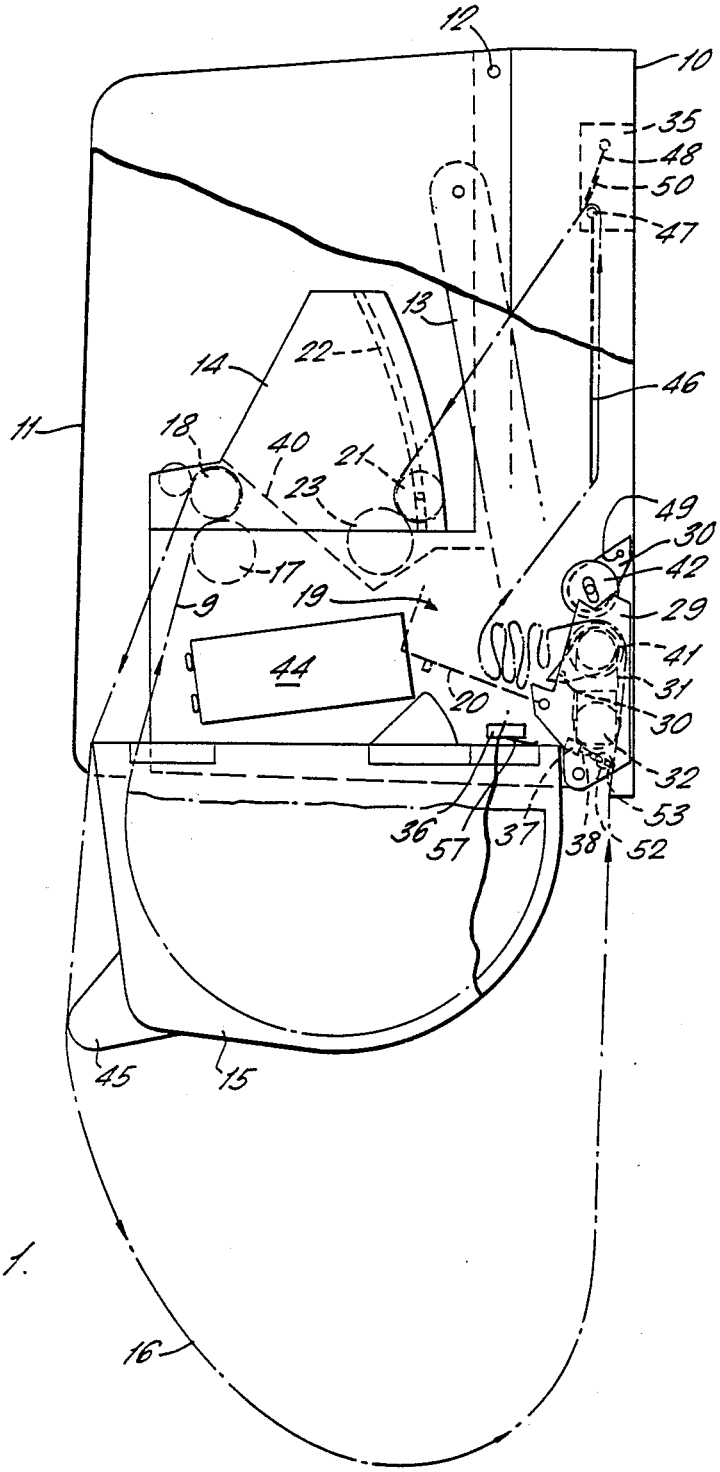
FIG. 1 is a side elevation by way of example, of a continuous towel cabinet, part of the cover being cut-away.
Figure 2:
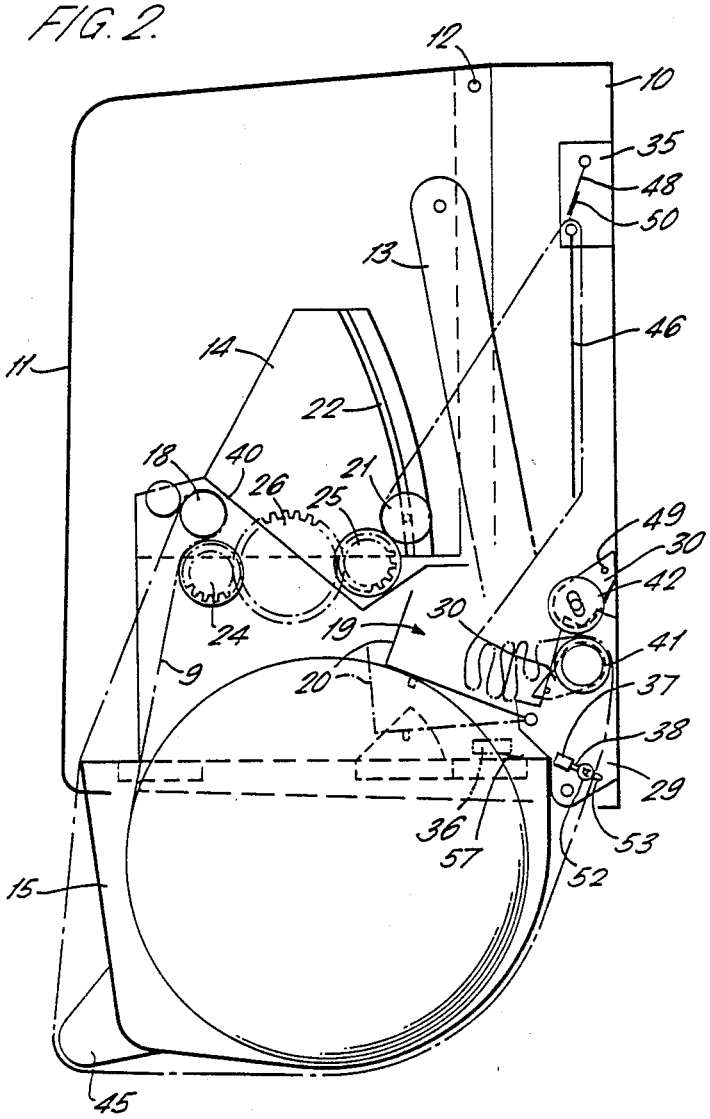
FIG. 2 is a section through the towel cabinet of FIG. 1.
Figure 3:
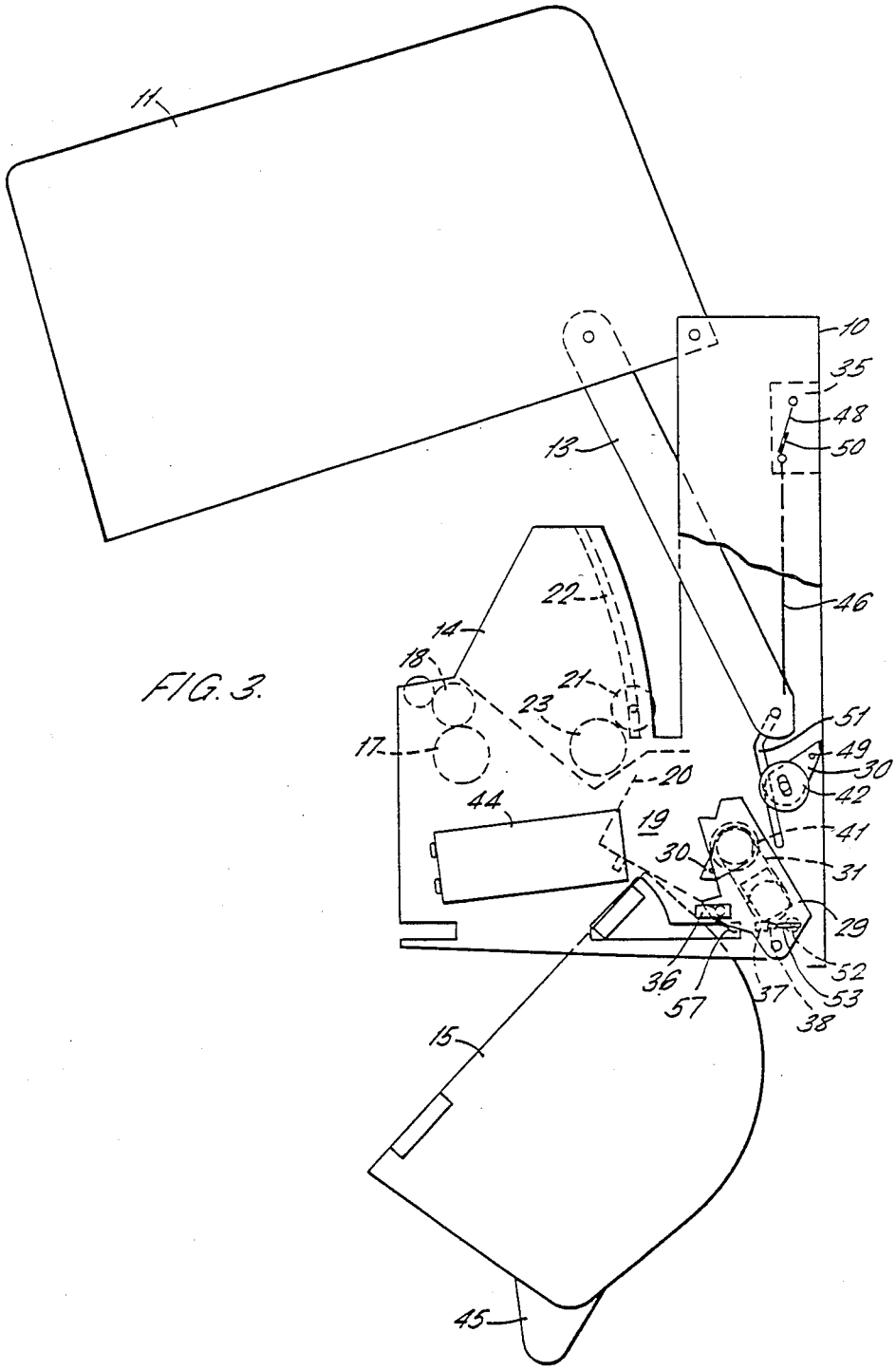
FIG. 3 shows the towel cabinet of FIG. 1 in side elevation with the cover raised and the clean towel bin in its reloading position.
Figure 4:
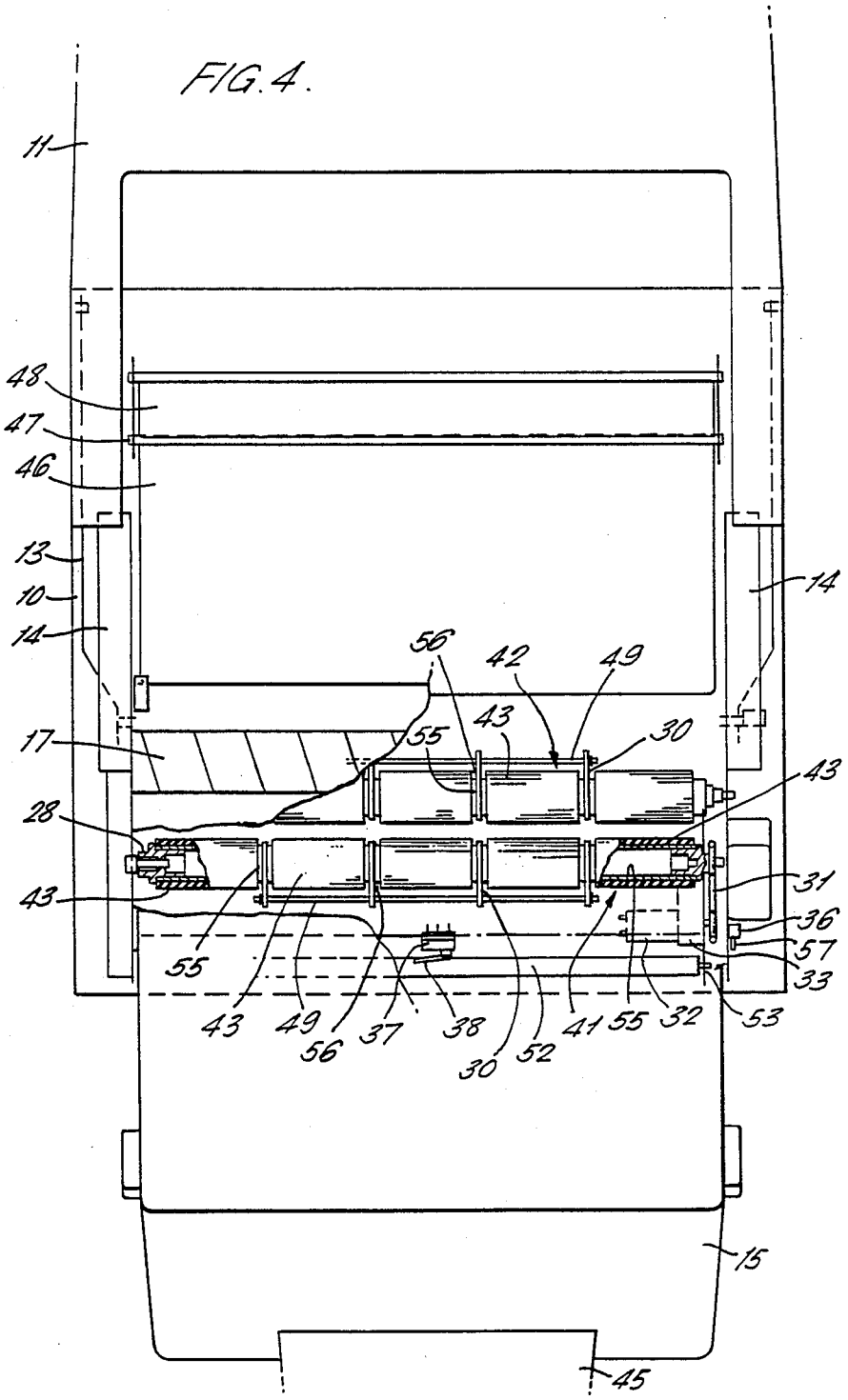
FIG. 4 is a front elevation of the towel cabinet as shown in FIG. 3, part cut-away and part in section.

Referring to the drawings, a continuous towel cabinet comprises a back portion 10 to which a front cover 11 is hinged by pivots 12 and supported by side props 13. The lower ends of the props are attached for sliding movement in slots 51 (FIG. 3). The back portion 10 incorporates two side walls 14 from which a clean towel bin 15 is hung. When the cover 11 is open, the bin 15 is capable of forward and downward movement into a loading position (FIGS. 3 and 4), but is normally held locked in its operative position (FIGS. 1 and 2) by the closed cover.

Between the side walls 14 extend an arrangement of rollers which allow clean towel 9 to be dispensed from a roll within the bin 15 into a loop 16 below the bin. At the upstream end of the towel path, the towel passes upwardly over a roughened metering roller 17, around a guide roll 18 and then downwardly into the loop 16. The towel 9, which is then described as soiled towel, is withdrawn into the cabinet by take-up means comprising a pair of rollers 41, 42. The soiled towel is fed by the rollers 41, 42 into a compartment 19 formed by a pivotally mounted tray 20. At least initially the tray rests on the roll of clean towel in the bin 15. The tray 20 and a partition 40 also combine to keep the soiled towel clearly separate from the clean towel roll in the bin 15. The compartment 19 acts as a store for the soiled towel before it is rewound onto the rewind roller 21 mounted in generally upwardly extending grooves 22 in the side walls 14 and which is driven by another roughened metering roller 23 through the outermost turn of the towel which has been rewound. At each end of each metering roller 17, 23 is a respective gear wheel 24, 25 which wheels mesh with an intermediate gear wheel 26 (FIG. 2). The gear wheels 24, 25 have the same number of teeth so that the length of soiled towel rewound on the rewind roller 21 is the same as the length of towel dispensed at the front of the cabinet. Hence, in operation, when clean towel is dispensed by the user to form a loop 16, an equivalent length of soiled towel is withdrawn from the compartment 19 and rewound onto the rewind roller 21. As the roll of soiled towel increases in diameter, the rewind roller 21 slides up the grooves 22.

Within the compartment 19, the soiled towel is stored in a folded or flaked state. Therefore, before the towel is rewound onto the rewind roller 21, the towel is passed behind a vertical hanging plate 46 which is pivotally mounted about its top edge 47. In operation, the plate can swing and thereby acts to deflake the towel and prevent it from bunching. The top edge 47 of the plate 46 also comprises one member of a wedging arrangement between which the towel passes in its path towards the rewind roller 21. The other member is a second pivoted plate 48 whose bottom edge engages the towel and lies just inside the top edge 47 of the plate 46. On the towel engaging surface of the bottom edge is a rubber strip 50. The towel thus passes freely between the plates 46, 48 towards the rewind roller 21, but cannot be pulled backwards by the user because of the jamming effect of the plate 48. The plate 48 thus acts to prevent soiled towel being pulled off the rewind roller 21.

To limit the length of clean towel which is dispensed at any one time, there is provided a device (not shown) for stopping rotation of the front metering roller 17 in the direction it rotates when the towel is being dispensed, after a given length of towel has been dispensed. In this embodiment, the stop device is the same as the stop device described in British Patent Specification No. 2096099.

The cycle of dispensing and rewinding successive lengths of towel is repeated until the end of the towel roll is reached. At the end of each dispensing cycle, the user may use the loop 16 to dry his hands. To enable the user to comfortably insert his fingers behind the edges of the towel and thereby to grid the towel in order to be able to dispense it to form the loop 16, there is provided a blister-like projection 45 on the bottom front edge of the bin 15. The blister 45 acts to space the front section of the loop, when retracted, away from the surface of the bin. The blister 45 is also disposed centrally of the towel and its lateral dimension or length is less than the width of the towel. After a predetermined period of time, as described below, the loop is retracted until the towel passes tightly beneath the bin 15,. the length of towel which is taken up being withdrawn by the rollers 41,42 into the compartment 19.

For this purpose, the upper roller 42 is a pressure roller mounted in end slots so that under its own weight it applies a constant pressure on the towel acting to tension the towel. However, the slots allow substantial vertical movement of the roller 42 relative to the towel, if necessary, in case the towel should temporarily crease or contain joins. Also, in one end of the roller 42 is a unidirectional clutch bearing of the same form as the clutch bearing described below in connection with the lower roller 41. The lower roller 41 is a drive roller which is mounted on a carriage comprising brackets 29 which are pivotally connected to the side walls 14 and which are held in their uppermost positions (FIGS. 1 and 2) by engagement with the clean towel bin 15. Movement of the bin forwardly and downwardly into its loading position (FIG. 3) allows the brackets to pivot and thereby separate the roller 41 from the roller 42 to provide a gap therebetween through which the leading end of a fresh roll of towel may be threaded before being manually wound onto the rewind roller 21. The lower roller 41 also has a unidirectional clutch bearing 28 (FIG. 4) in one end, the clutch bearings in the rollers 41, 42 combining to resist rotation of the respective roller in the reverse directional movement of the towel, thereby at least resisting the user from pulling soiled towel from the back of the cabinet. Each roller 41, 42 in this embodiment, has an inner sleeve 55 on which are assembled a set of five outer, longitudinally fluted rubber sleeve portions 43 for gripping the towel. The outer sleeve portions 43 of each roller 41, 42 are spaced apart to form grooves 56 for locating stripping members 30 which prevent the towel from wrapping itself around the respective roller instead of passing into the compartment 19. In this embodiment, each stripping member 30 is a generally triangular shaped plate which loosely surrounds the inner sleeve 55 of the respective roller and is carried by a common mounting rod 49 for the stripping members of that roller. The stripping members thus float during rotation of the rollers.

The drive to the roller 41 is a belt drive 31 driven by an electric motor 32 via a gear box 33. Alternatively, the drive 31 may be a chain drive or gear train. In this embodiment, the clutch bearing 28 in the roller 41 is a needle roller clutch bearing which allows the roller 18 to be rotated freely when driving the towel into the cabinet, but is engaged if a torque is applied in the reverse direction, i.e. if the user tries to pull the towel back. The clutch bearing in the upper roller 42 is also of a similar type, but in either case the clutch bearing may be of another type, e.g. having a ratchet or pawl arrangement.

The drive motor 32 is an electric motor, operated from an independent low power DC energy source 34, for example one or more alkaline batteries 44, disposed within the cabinet.

The control means for the electric motor 32 is an integrated circuit 35 which in this embodiment is made operative, in that it senses a voltage, when the clean towel bin 15 is in its raised operative position. This is achieved by a micro-switch 36 having a lever which is operated to make or break the switch 36 by movement of the bin 15 into and from its operative position respectively. In an alternative arrangment one of the side walls 14 carries a steel strip 36 which is electrically connected to the circuit and which, during the closing movement of the cover, makes contact with one of the side props 13 and thereby earths out on the back portion 10 of the cabinet.

The control means further include sensing means responsive to the tension in the towel. The sensing means is a micro- switch 37 (FIG. 2) having a lever 38 operated by a bar 52 to close the switch 37 and thereby switch off the motor 32, when the towel is tight, i.e. when the loop 16 is retracted against the underside of the clean towel bin 15. The sensing means is thus activated by the tension in the towel and, in this embodiment, the bar 52 makes contact with the towel across its complete width. This is an advantage because should the loop of towel become bunched at one side or the other, perhaps through misuse, the mechanism will remain operative to retract the loop. The ends of the bar 52 are mounted in slots 53 inclined downwardly away from the switch 37, the bar being pushed up the slots to switch off the motor 32 when the towel is tight (FIG. 2). The micro-switch 37 is also disposed mid-way along the bar 52. Thus should side bunching of the towel occur, the bar can pivot within the limits of the slots 53 without affecting its operation of the micro-switch. Dispensing fresh towel loosens the towel, and allows the bar 52 to fall down the slots 53 thereby removing its pressure on the lever 38. The micro-switch 37 opens and after a time delay, e.g. 7 seconds, controlled by the integrated circuit, the motor 32 is switched on to retract the loop 16. The integrated circuit also determines the maximum period of operation of the motor, which, in this embodiment, is 8 seconds. In normal operation, of course, the full period of operation is not employed because the loop retracts in less than 8 seconds and the motor 32 is switched off by the micro-switch 37. However, when the end of the towel is reached, the time period of operation of the motor is sufficient to withdraw into the cabinet the trailing end, the motor switching off at the end of the full period. If, during normal retraction of the loop 16 or during withdrawal of the trailing end of the towel, the towel should be held, the cycle is automatically stopped and restarted, including an initial time delay and the available full period of operation of the motor, when the towel is no longer held. If necessary the stop and restart process will be repeated until the loop has been retracted or the trailing end withdrawn.

In practice it is found that movement of the towel by the user causes the bar 52 to oscillate within the limits of the slots 53 thereby opening and closing the switch 37 controlling the motor. Each time the switch 37 is opened, as if the towel has been released by the user, the predetermined time delay will be started again, but if the switch is then closed by movement of the bar away from the micro-switch, the circuit is automatically reset. Similarly, if the towel is released and then regripped by the user, before the loop is retracted, the switch 37 will be closed and the circuit reset. When the towel has been finally released the switch 37 will remain open and the loop will be retracted, by operation of the motor, after the predetermined time delay. For these reasons, it is essential that the drive roller 41 is driven by an electric motor for which a suitable integrated circuit can readily be provided. The same result could not be achieved if the roller 41 were to be driven by mechanical means.

It is emphasised that in the preferred embodiment described above there is no usage of current from the energy source other than during the operative cycle of the integrated circuit.

Moreover, because the soiled towel is rewound in a conventional manner, should there arise an electrical failure or battery failure, the towel cabinet will still operate. Clean towel will be dispensed and an equivalent length of soiled towel will be rewound, the towel passing directly from the rollers 41, 42 to the top edge 41 of the plate 46, thereby bypassing the compartment 19. Otherwise, all that will change is that the loop 16 will not be withdrawn at the end of each cycle of operation.

I claim:

1. A continuous towel cabinet comprising:

(a) a holder for a roll of clean towel;

(b) an arrangement of roller means for repeatedly feeding lengths of clean towel into a loop beneath the holder and for simultaneously rewinding equivalent lengths of soiled towel onto a rewind roller;

(c) take-up means, operable independently of said roller means, for retracting the loop after operation of the roller means, said take-up means having a drive roller for engaging the towel, an electric motor for driving the drive roller, said towel cabinet having a self-contained-power source for actuating said electric motor;

(d) control means for controlling the motor, said control means including a time delay means and means for sensing tension in the towel, said control means being operable to retract the loop by operating the motor after the towel is released by the user and after a time delay, said control means stopping the motor after the loop is retracted; and (e) a compartment for receiving the length of towel withdrawn by the take-up means, whereby the soiled length of towel within the compartment will be wound onto the rewind roller during a subsequent cycle of operation.

2. A continuous towel cabinet as claimed in claim 1, wherein the control means are reset in the event of the sensing means sensing tension in the towel after the towel has been released by the user and before the loop has been retracted.

3. A continuous towel cabinet as claimed in claim 1, wherein the power source for the electric motor is at least one alkaline battery.

4. A continuous towel cabinet as claimed in claim 1, wherein the take-up means comprises the drive roller and a pressure roller which, in use, holds the towel against the drive roller, one of said rollers being mounted for pivotal movement away from the other roller during the cycle of reloading the cabinet with a fresh roll of clean towel to allow the leading end of the new roll to be passed therebetween.

5. A continuous towel cabinet as claimed in claim 4, wherein the clean towel holder is movable into an open position for reception of a fresh roll, and wherein the pivoted roller is mounted on a carriage engageable by the clean towel holder whereby the clean towel holder moves the pivoted roller to its inoperative position when the holder is moved into its open position.

6. A continuous towel cabinet as claimed in claim 1, including means for deflaking the soiled towel as it passes from the compartment onto the rewind roller.

7. A continuous towel cabinet as claimed in claim 6, wherein the deflaking means comprises a hanging plate over the surface of which the towel passes, the plate being capable of a swinging motion about its top edge thereby acting to prevent the towel from bunching.

8. A continuous towel cabinet as claimed in claim 1 wherein the take-up means has a unidirectional clutch bearing which prevents reverse movement of the towel.

9. A continuous towel cabinet as claimed in claim 1, wherein between the compartment and the rewind roller the towel passes between further means which at least restrict back movement of the towel thereby preventing soiled towel from being pulled off the roll of soiled towel.

10. A continuous towel cabinet as claimed in claim 1, wherein the sensing means is a micro-switch operated by a bar extending transversely of the towel, the bar being mounted for movement towards the micro switch by the towel when the towel is tightened and away from the micro-switch when the towel is loose.

11. A continuous towel cabinet as claimed in claim 1, wherein means are provided for spacing a section of the front of the loop, when retracted, away from the clean towel holder to allow the user to insert his fingers between the towel and the holder in order to grip the edges of the towel before dispensing further clean towel into a loop beneath the holder.

12. A continuous towel cabinet as claimed in claim 11, wherein said towel spacing means is a blister-like projection on the front of the clean towel holder, the projection being disposed centrally of the path of the towel and having a lateral dimension which is less than the width of the towel.

* * * * *